US005457939A

United States Patent [19]

Bardou et al.

[11] Patent Number: 5,457,939

[45] Date of Patent: Oct. 17, 1995

[54] PROCESS FOR VACUUM-PACKAGING FOODSTUFFS IN RIGID CONTAINERS

[75] Inventors: Jean-Francois M. Bardou; Roland Guezenneč; Jean-Pierre Lhommond, all of Marmande, France

[73] Assignee: Optimal Food Processing Research, Inc., Dover, Del.

[21] Appl. No.: 115,724

[22] Filed: Sep. 1, 1993

[51] Int. Cl.[6] ..... B65B 31/02

[52] U.S. Cl. ..... 53/432; 53/403; 53/405; 53/408; 53/431; 426/403; 426/404

[58] Field of Search ..... 426/403, 404; 53/403, 405, 407, 408, 431, 432, 440

[56] References Cited

U.S. PATENT DOCUMENTS

| | | | |
|---|---|---|---|
| 1,773,311 | 8/1930 | Killen . | |
| 1,808,702 | 6/1931 | Williams . | |
| 1,920,539 | 8/1933 | White . | |
| 1,931,911 | 10/1933 | White | 53/408 X |
| 2,286,999 | 6/1942 | Smith | 426/404 |
| 2,870,027 | 1/1959 | Romero | 426/404 |
| 3,125,452 | 5/1964 | Parodi | 426/404 |
| 3,281,300 | 10/1966 | Warner . | |
| 3,410,436 | 11/1968 | Foss et al. . | |
| 3,501,318 | 3/1970 | Wilson . | |
| 3,783,581 | 1/1974 | Pierce . | |
| 3,807,134 | 4/1974 | Zalkin . | |
| 3,844,093 | 10/1974 | Cato . | |
| 3,845,605 | 11/1974 | Hartness . | |
| 3,845,606 | 11/1974 | Wilson . | |
| 3,875,318 | 4/1975 | Davies . | |
| 3,972,153 | 8/1976 | Kiellarson et al. . | |
| 3,996,725 | 12/1976 | Walles et al. . | |
| 4,016,705 | 4/1977 | Wilson et al. . | |
| 4,059,919 | 11/1977 | Green . | |
| 4,081,942 | 4/1978 | Johnson . | |
| 4,148,933 | 4/1979 | Janovtchik | 53/407 X |
| 4,156,741 | 5/1979 | Beauvais et al. . | |
| 4,199,914 | 4/1980 | Ochs et al. . | |
| 4,400,401 | 8/1983 | Beauvais et al. . | |
| 4,689,936 | 9/1987 | Gaikema et al. . | |
| 4,703,609 | 11/1987 | Yoshida et al. | 53/432 X |
| 4,707,334 | 11/1987 | Gerhard . | |
| 4,716,708 | 1/1988 | Ochs . | |
| 4,717,575 | 1/1988 | Larroche . | |
| 4,968,516 | 11/1990 | Thompson . | |
| 5,071,667 | 12/1991 | Grune et al. | 53/432 X |
| 5,077,954 | 1/1992 | Williams . | |

FOREIGN PATENT DOCUMENTS

| | | | |
|---|---|---|---|
| 161428 | 7/1954 | Australia | 426/404 |
| 2165701 | 8/1973 | France . | |
| 2268694 | 11/1975 | France . | |
| 2289395 | 5/1976 | France . | |
| 2360474 | 3/1978 | France . | |
| 2561620 | 9/1985 | France . | |
| 2669605 | 5/1992 | France | 53/440 |
| 1455652 | 11/1976 | United Kingdom | 53/403 |

*Primary Examiner*—John Sipos
*Assistant Examiner*—Daniel Moon
*Attorney, Agent, or Firm*—Seidel Gonda Lavorgna & Monaco

[57] ABSTRACT

A process for packaging foodstuffs in substantially rigid containers. A desired quantity of foodstuff to be packaged is placed in the container, a quantity of aqueous liquid in an amount sufficient to generate, when boiled, a volume of vapor sufficiently in excess of the volume of the container to substantially completely displace all other gases from the container, is added. The container is closed but not sealed, so as to permit communication between the interior of the container and the ambient atmosphere. The container and its contents are warmed to a temperature sufficient to generate the volume of vapor when the container is subjected to a pressure lower than atmospheric pressure. The temperature is kept as low as possible so that no cooking of the foodstuffs occurs. After warming, the containers are exposed to a low pressure so that the liquid in the container boils. The boiling liquid generates vapor in the container sufficient to drive out and displace other gases from the container. The container is hermetically sealed while exposed to the subatmospheric pressure.

14 Claims, 6 Drawing Sheets

PROCESS FOR VACUUM-PACKAGING FOODSTUFFS IN RIGID CONTAINERS

FIELD OF THE INVENTION

The present invention pertains to an improved process for packaging of foodstuffs and comestibles in rigid containers for preservation and storage.

BACKGROUND OF THE INVENTION

Canning or otherwise packaging foods to preserve and store them for long periods of time has been an important part of food processing since the eighteenth century, when a Parisian chef named Appert devised a crude method of canning. Appert's process was introduced into the United States through England in about 1818. Canning remained an inexact process until Louis Pasteur applied his principles of fermentation to it in 1895.

Today, from picking to packaging, canning is a highly-developed, scientific industry. Foodstuffs are packaged in many different types of containers, with metal cans, glass jars and plastic packages being used on a wide scale. For convenience, the packaging of foodstuffs in rigid containers (i.e., cans, jars and rigid plastic packages) will be referred to collectively herein as "canning". No matter what type of container is used, however, all canning processes must deal with the sensitivity of most foods to oxygen. As anyone who has sliced a fresh apple knows, oxygen in the air immediately begins to react with fresh foods and leads to the loss of their organoleptic qualities and to their rapid spoilage. All foods are sensitive to oxygen in varying degrees, and the successful preservation of foods by canning requires, as an important step, the elimination of oxygen from the containers.

Conventional canning processes rely on the use of liquids to displace oxygen and other gases from the containers. Typically, the foodstuffs being canned are placed in the containers and then covered with a liquid, which may be water, brine, or syrup. The covering liquid is preheated to a temperature of about 100° C. before it is added to the containers. The liquid thus displaces the air and other gases in the containers. The containers are then sealed while at that temperature. The heated liquid at temperatures near 100° C. is hot enough to begin cooking the foodstuffs even before the containers are subjected to further processing, such as sterilizing. Usually, the containers are also further heated to temperatures between 115° C. and 140° C. in order to sterilize the contents.

Clearly, the conventional methods of canning, while offering many advantages, also suffer certain drawbacks. Raising the temperature of the food to the boiling point at least partially cooks the food, resulting in some loss of texture, color, taste and other indicia of freshness. In addition, the liquid in which the food is packaged can itself react with the food, or with the container, which can lead to undesirable changes in taste, color or aroma.

Attempts have been made to overcome these drawbacks, but they have not been entirely successful. Some foods which do not react vigorously with oxygen, such as sweet corn, can be processed in a vacuum obtained by pumping out the gases from the container before sealing it and sterilizing it. The level of vacuum so obtained is limited, however. Moreover, this method is not suitable for most of the aqueous foods (e.g., fruits and vegetables with high water content), since these foods include oxygen-sensitive compounds such as polyunsaturated fatty acids, tannins, vitamins, and so forth. Even low oxygen levels resulting from vacuum packaging are enough to lead to deterioration of aqueous foods so packaged.

A recent approach to overcoming the problems with canning aqueous foods is shown in U.S. Pat. No. 4,717,575. In that patent, aqueous foods are placed in containers such as metal cans and covered with water. The cans are filled with water to the brim, so that water completely covers the foods. The cans are then placed in a steam chamber in which they are surrounded by a steam atmosphere substantially devoid of air. While in the steam chamber, the cans are either tilted or inverted to cause some or all of the water to be removed from the cans. The water thus removed from the cans is replaced by steam from the surrounding steam atmosphere. The cans are then sealed in the steam atmosphere at either atmospheric or superatmospheric pressure. After sealing, the cans are cooled. The cooling step causes the water vapor in the cans to condense, creating a vacuum in the cans.

The process disclosed in U.S. Pat. No. 4,717,575 is cumbersome and does not solve the problems of conventional canning methods. The process requires a steam chamber with a steam atmosphere at pressures equal to or greater than atmospheric pressure. The dangers of steam pressure vessels are well-known and need not be repeated here. The process also requires the cans to be filled to the brim with boiling water before the cans are introduced into the steam chamber, but then the water is poured out inside the steam chamber to allow steam to replace it. (As a practical matter, boiling water must be used in order to exchange the water for steam. If the water were cooler than 100° C., it would partially or totally condense the steam, making the substitution of steam for water impossible.) This is not only wasteful, but requires complex machinery for tilting or inverting the cans, and a perforated grille on the cans to keep the food inside the cans while the water is being poured out. What is worse, the subjection of the food in the containers to boiling water and then to high-temperature steam partially cooks the food, leading to a degradation in the food's organoleptic properties and freshness appeal. The process further requires the cans to be sealed inside the steam chamber, which necessitates sealing equipment that can operate in the severe, corrosive environment of wet steam.

The present invention provides a process which attains a high level of vacuum in the containers at low temperatures, eliminating the air and other gases from the containers by a novel and inventive combination of pressures and temperatures. The present invention makes it possible to obtain a hermetically sealed container devoid of air and oxygen without cooking the product. Moreover, no special, complex equipment is required to invert cans, or to seal cans inside a high-temperature steam environment. Only little liquid is used compared to conventional methods, which makes the process much more economical than prior processes which require filling the containers with liquid and then pouring off the liquid before sealing.

The process of the present invention embodies the advantages of canning without the concomitant disadvantages of prior processes, and results in a canned foodstuff which retains all its desirable organoleptic properties.

SUMMARY OF THE INVENTION

The present invention is directed to a process for packaging foodstuffs in substantially rigid containers. The present invention provides a way of achieving a high level of vacuum in the container after processing, better conditions of thermal treatment, and elimination of undesired oxygen and other gases by a unique combination of processing temperature and pressure, making it possible to provide a hermetically sealed container devoid of oxygen without cooking the foodstuffs therein. The present invention also makes it simple to sterilize or pasteurize the foodstuffs after the container has been sealed.

The process of the invention comprises the steps of: placing a desired quantity of foodstuff to be packaged in a container; adding to the container a quantity of aqueous liquid in an amount sufficient to generate, when boiled, vapor having a volume sufficiently in excess of the volume of said container to substantially completely displace all other gases from said container; dosing but not sealing the container so as to permit communication between the interior of the container and the ambient atmosphere; warming said container and its contents to a temperature sufficient to generate said volume of vapor when said container is subjected to a pressure lower than atmospheric pressure, said temperature being as low as possible so that no cooking of the foodstuffs occurs; exposing the warmed container to an ambient atmosphere having a pressure lower than atmospheric pressure, the ambient subatmospheric pressure being chosen so that the combination of the temperature of the liquid in the warmed container and the ambient subatmospheric pressure will result in the boiling of the liquid and the generation of vapor in the container sufficient to drive out and displace all other gases from the container; and hermetically sealing the container while it is exposed to the subatmospheric pressure.

DESCRIPTION OF THE DRAWINGS

For the purpose of illustrating the invention, there is shown in the drawings a form which is presently preferred; it being understood, however, that this invention is not limited to the precise arrangements and instrumentalities shown.

DESCRIPTION OF THE INVENTION

Figure 1:
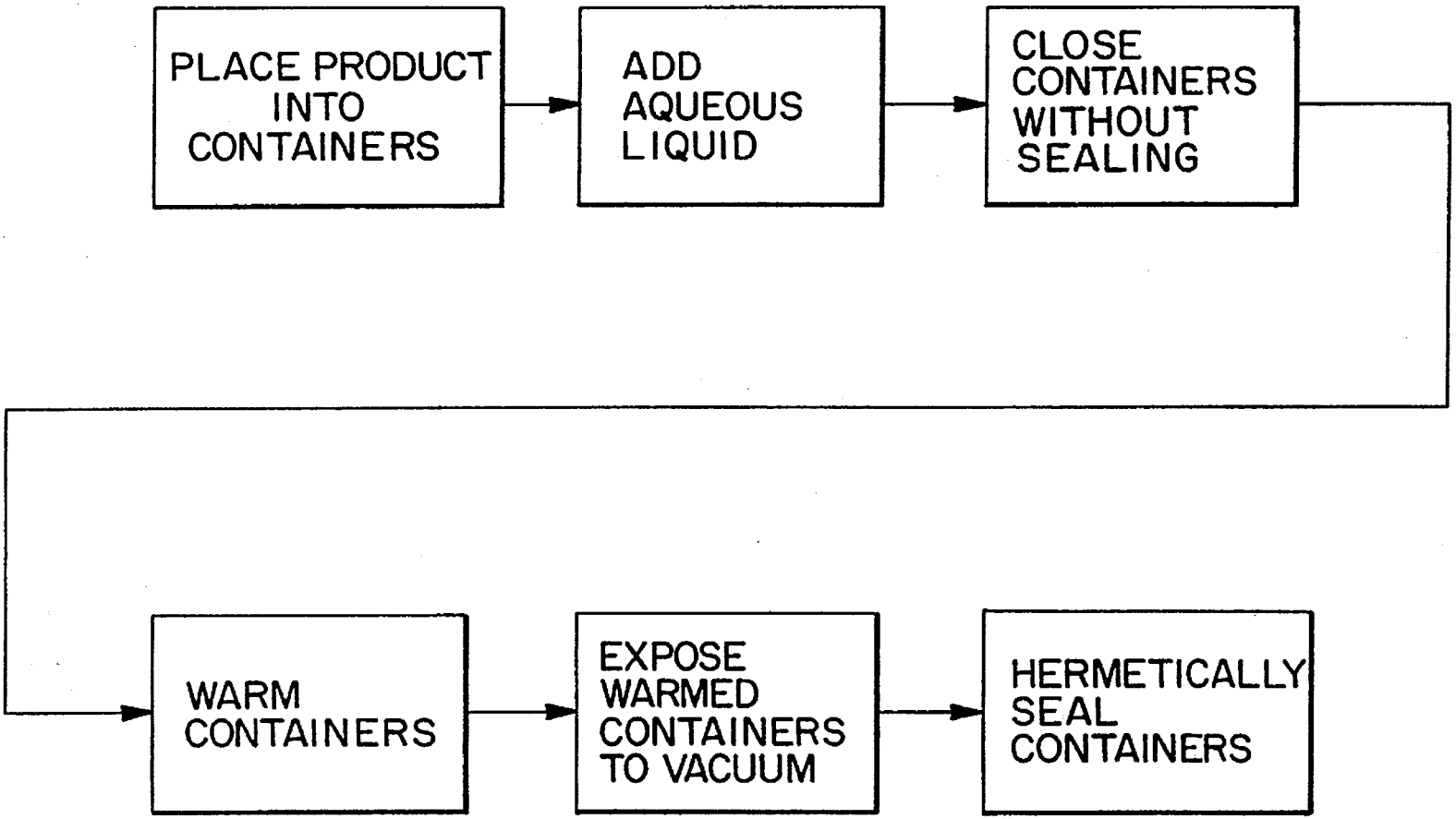
FIG. 1 is a simplified block diagram illustrating the steps according to the invention.

Referring now to the drawings, the process according to the invention is illustrated in its broadest form in the block diagram of FIG. 1. Foodstuffs and comestibles to be canned are first obtained and prepared according to conventional techniques. (As used herein, "canned" or "canning" means packaging foodstuffs in rigid containers, whether those containers are metal cans, glass jars, substantially rigid plastic containers, or any other suitable containers.) Thus, for example, fresh vegetables are washed and cleaned, cut into pieces if desired, have leaves and stems removed as required, and so forth. Although the invention is particularly useful in the canning of vegetables, it is not limited to the canning of vegetables but is applicable to the canning of fruits, mushrooms, vegetable-based dishes, ready-made dishes based on meats, poultry and fish, and is also applicable to liquid products such as fruit juices and soup. These will be referred to herein collectively as "products" or "foodstuffs".

After the product to be canned has been prepared as desired, it is placed in the desired containers. Preferably, such containers comprise glass jars, but other rigid containers, such as metal cans or substantially rigid plastic containers, may be used without departing from the invention.

After the product has been placed in the containers, a small amount of aqueous liquid is added to the containers. The amount of liquid required is an amount which, when brought to a boil, is sufficient generate a volume of vapor approximately ten times, or more, the volume of the container. A recommended amount is an amount sufficient to generate a volume approximately fifty times the volume of the container. In accordance with the invention, enough liquid is used to generate the desired amount of vapor while leaving a small amount of liquid not converted to vapor and remaining in the container as liquid. Preferably, the amount of liquid added is approximately five percent by volume of the container, as it has been found that this amount of liquid is enough to generate the desired volume of vapor and leave a small amount in the container as liquid. The small amount of liquid left in the container will facilitate heat transfer during subsequent processing. The aqueous liquid may be water, brine, syrup, or other suitable canning liquid.

After adding the liquid to the containers, the containers are closed without sealing them. For example, if the containers comprise glass jars, the jars may be capped with standard "60 degree" screw-top lids. It is important to note that, at this step, after the containers are capped they are not sealed, so that the interior of the containers is in communication with the ambient atmosphere. Alternatively, it is within the invention to close the containers tightly, but not seal them, so that they are not in communication with the ambient atmosphere, and then partially open them during the vacuum exposure step, to be described below, so that the interior of the containers will be in communication with the vacuum after partial opening.

The closed but unsealed containers then enter the warming, or preheating, phase of the process. The containers and their contents are warmed to a temperature well below 100° C., so that no cooking of the product occurs during warming. The exact temperature to which the containers are warmed is not critical, as long as the temperature is sufficient to cause the liquid in the containers to boil when they are subjected to subatmospheric pressure, as will be described below. A typical temperature is 60° C., which is sufficient to cause water to boil at a subatmospheric pressure of 0.2 bars absolute. (One bar is approximately equal to one atmosphere of pressure.) The precise way in which the containers may be warmed is likewise not vital to the invention, and the preheating may be carried out by any heating method or apparatus able to maintain the desired temperature to within ten percent.

After being warmed to the desired temperature, the containers are exposed to a subatmospheric pressure or vacuum. One way of achieving this is to introduce the containers into a vacuum chamber within which a constant subatmospheric pressure or vacuum is maintained via mechanical or thermodynamic pumping. The subatmospheric pressure is chosen in conjunction with the desired temperature so that when the containers are exposed to the subatmospheric pressure, the preheated liquid will come to a boil. As noted above, the containers, while closed, are either open to the ambient low pressure or are partially opened inside the vacuum chamber so that the interior of the containers is open to the vacuum.

It is well known that the behavior of an ideal gas is governed by Boyle's Law, PV=nRT, where P is pressure, F is volume, n is the number of tools of gas present, R is the ideal gas constant, and T is temperature. From this equation, the following table may be derived:

TABLE 1

| ABSOLUTE PRESSURE bar | BOILING TEMPERATURE °C. | SPECIFIC VOLUME $m^3/kg$ |
|---|---|---|
| 0.1 | 45.81 | 14.674 |
| 0.2 | 60.06 | 7.649 |
| 0.3 | 69.1 | 5.229 |
| 0.4 | 75.87 | 3.993 |
| 0.5 | 81.33 | 3.24 |
| 0.6 | 85.94 | 2.732 |
| 0.7 | 89.95 | 2.365 |
| 0.8 | 93.5 | 2.087 |
| 0.9 | 96.71 | 1.869 |
| 1 | 99.63 | 1.694 |

From this table it can be seen that the temperature to which the container is warmed depends on the vacuum to which the container is exposed, and also on the volume of the container. For example, for a glass jar having a volume of 446 ml (roughly 32 oz), a quantity of 3 g of water at 60° C. will generate a volume of 23 l of water vapor when exposed to a pressure of 0.2 bars, or about 50 times the volume of the jar (7.649 $m^3$/kg=7.649 l/g, multiplied by 3 g gives 22.92 l). Hence, in this example, for a glass jar having a volume of 446 ml, adding 3 g of water, warming the jar to a temperature of 60° C. and then exposing the jar to a vacuum of 0.2 bars will result in the generation of a volume of water vapor fifty times the volume of the jar. This quantity of water vapor is sufficient to drive out and displace from the interior of the jar all oxygen and other gases present in the jar. Consequently, the contents of the jar are surrounded by an ambient environment consisting of only water vapor.

While still in this condition, i.e., while the containers are still at the preheating temperature and subatmospheric pressure, the containers are hermetically sealed, thus sealing in the ambient water vapor environment within the container. The sealing operation used is chosen to accommodate the type of container used, such as a conventional lid-screwing device for glass jars or a seamer for metal cans, but the sealing operation is otherwise not vital to the present invention.

Following sealing, the sealed containers exit the vacuum chamber and are ready for further processing if desired. For example, the jars may immediately proceed to thermal processing (e.g., a pasteurization step or a sterilization step) if desired, or may be cooled as an intermediate step to further processing, such as when it is desired to intermediately stock containers for subsequent thermal processing. Alternatively, the containers may be refrigerated so as to preserve the contents of the containers as near as possible to a "fresh" condition.

Although not indispensable to the present invention, it is deemed desirable in some cases to wrap transparent containers such as glass jars with a partially-opaque sleeve. It is known that some foodstuffs do not react well to light. In those cases where a sleeve is deemed desirable, thermally-retractable or "shrink wrap" material is preferred. The sleeve may also carry printed and/or graphic indicia, and serve as the container's labelling. For example, a PVC fill having a thickness of 50 microns or so, partially printed, would be suitable. It should be noted, however, that while minimizing light penetration into the container, a sleeve as described merely enhances the preservation method of the invention, and may be dispensed with if desired without departing from the invention.

Figure 2:
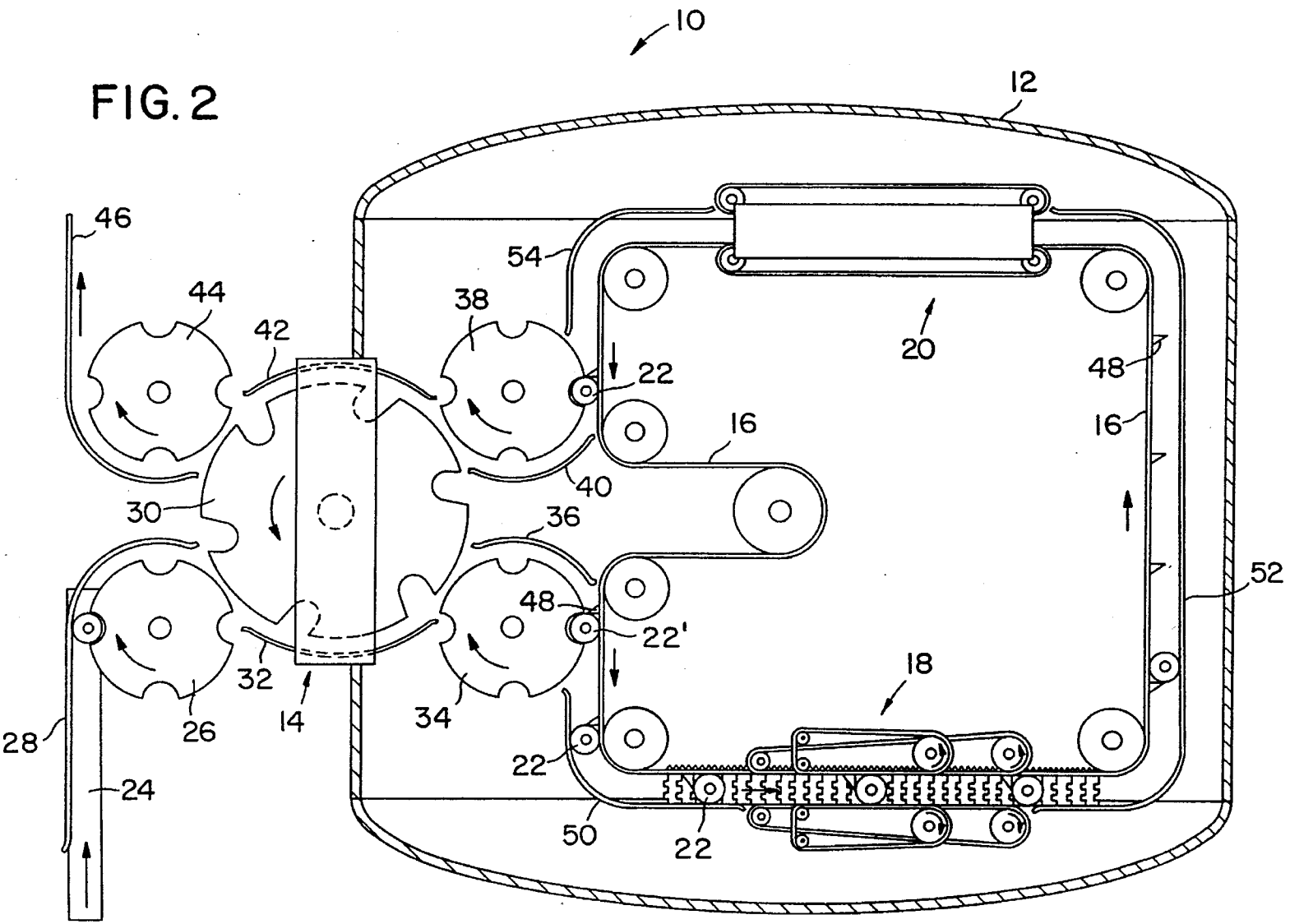
FIG. 2 is a plan view of a preferred form of apparatus for carrying out some of the steps of the process of the present invention.

One form of apparatus for conveniently carrying out the vacuum exposure step of the method according to the present invention is illustrated in FIGS. 2 through 5. FIG. 2 is a plan view of the apparatus, with the vacuum chamber shown in section. Apparatus 10 comprises a vacuum chamber 12, an air lock 14 through which containers enter and leave vacuum chamber 12, and a conveyor 16 for transporting containers within vacuum chamber 12. Apparatus 10 further comprises a means 18 for partially opening containers after they have entered vacuum chamber 12, and a sealing station 20 for hermetically sealing containers after generation of water vapor, as previously described. Further elements and features of apparatus 10 will now be described in conjunction with a description of the operation of the apparatus. In the particular embodiment of apparatus 10 illustrated and described, the containers are glass jars. However, it is believed that those skilled in the art will understand how to adapt apparatus 10 to other types of containers.

Individual jars 22 which have been filled with product and the requisite quantity of water, and then capped and warmed, are transported by an input conveyor 24 to a first transfer wheel 26. First transfer wheel 26 cooperates with guide rail 28 to transfer jar 22 to input/output wheel 30, which introduces and removes jars into and from vacuum chamber 12 through air lock 14. In cooperation with guide rail 32, input/output wheel 30 transfers jars from transfer wheel 26 through air lock 14 to second transfer wheel 34, which works in conjunction with guide rail 36 to transfer jars to conveyor 16. In similar manner, jars 22 are conveyed from vacuum chamber 12 by a third transfer wheel 38 and associated guide rail 40, input/output wheel 30 and associated guide rail 42 and fourth transfer wheel 44 and associated guide rail 46. A take-away conveyor (not shown) or other means for receiving jars 22 may be located along guide rail 46 downstream from fourth transfer wheel 44 to receive jars for further processing or for storing, as desired.

As shown in the drawings, transfer wheels 26 and 34 counter-rotate with respect to input/output wheel 30. In the illustrated embodiment, input/output wheel 30 rotates counterclockwise, and transfer wheels 26 and 34 rotate clockwise (although the wheels can rotate in the respective opposite senses in the event it is desired to move the jars 22 in the opposite direction). The use of transfer wheels to perform this function, and the structure of air lock 14, are known per se, and accordingly are not described in detail.

Conveyor 16 is preferably in the form of an endless belt or chain, and carries a plurality of lugs 48 which engage the jars 22. As illustrated in FIG. 2, a jar 22' is shown at the point of being engaged by a lug 48' as the jar 22' is about to leave transfer wheel 34. Jars thus engaged are guided by a guide rail 50 to jar opening means 18, which will be described in greater detail below. After leaving jar opening means 18, jars 22 are further guided by a guide rail 52 to sealing station 20, which, in the illustrated embodiment, may comprise a conventional jar sealer. Since sealing station 20 is conventional, it will not be described in detail. After leaving sealing station 20, the jars 22 are guided by a final guide rail 54 to third transfer wheel 38, from whence the jars are conveyed out of vacuum chamber 12.

In operation, vacuum chamber 12 is evacuated by a vacuum pump (not shown in the drawings), which may be any suitable mechanical or thermodynamic pump. Individual jars 22, which have been warmed to the required temperature corresponding to the level of vacuum inside vacuum chamber 12, are admitted into the interior vacuum chamber 12 via air lock 14. When jars 22 reach opening means 18 (to be described in detail below), the lids on the jars are partially opened, exposing the interior of the jars to the vacuum inside vacuum chamber 12. At that point, the liquid in jars 22 rapidly comes to a boil, and water vapor is generated inside the jar, expelling oxygen and other gases from the jar. This process continues as the jars move along conveyor 16 to sealing means 20. The speed of conveyor 16 is chosen to permit sufficient time for enough of the liquid in the jars to be transformed into the desired volume of water vapor. When the jars reach sealing station 20, they are hermetically sealed, in known manner, prior to being conveyed from vacuum chamber 12.

Figure 3:
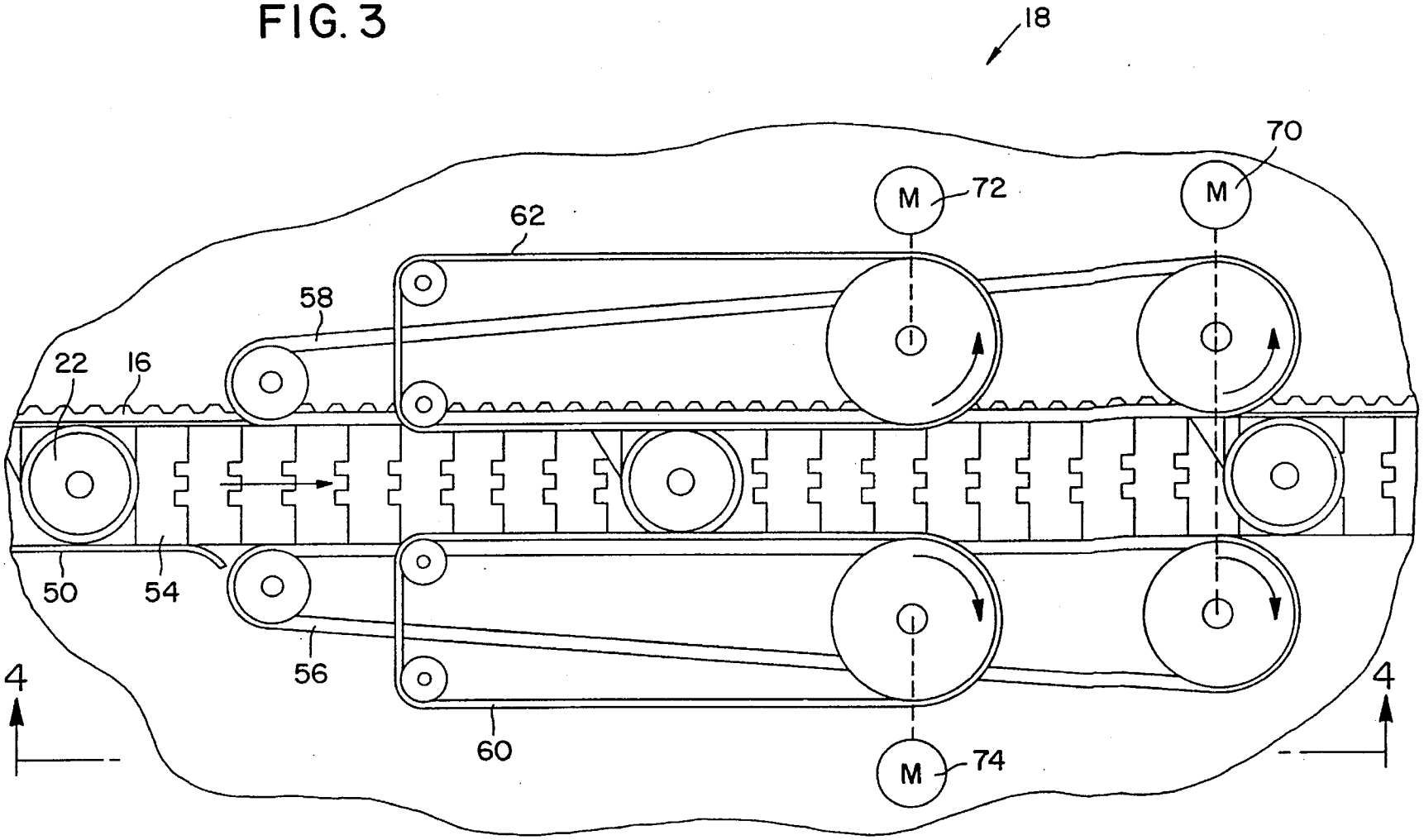
FIG. 3 is an enlarged view, partially broken away, showing a portion of the apparatus of FIG. 2.
Figure 4:
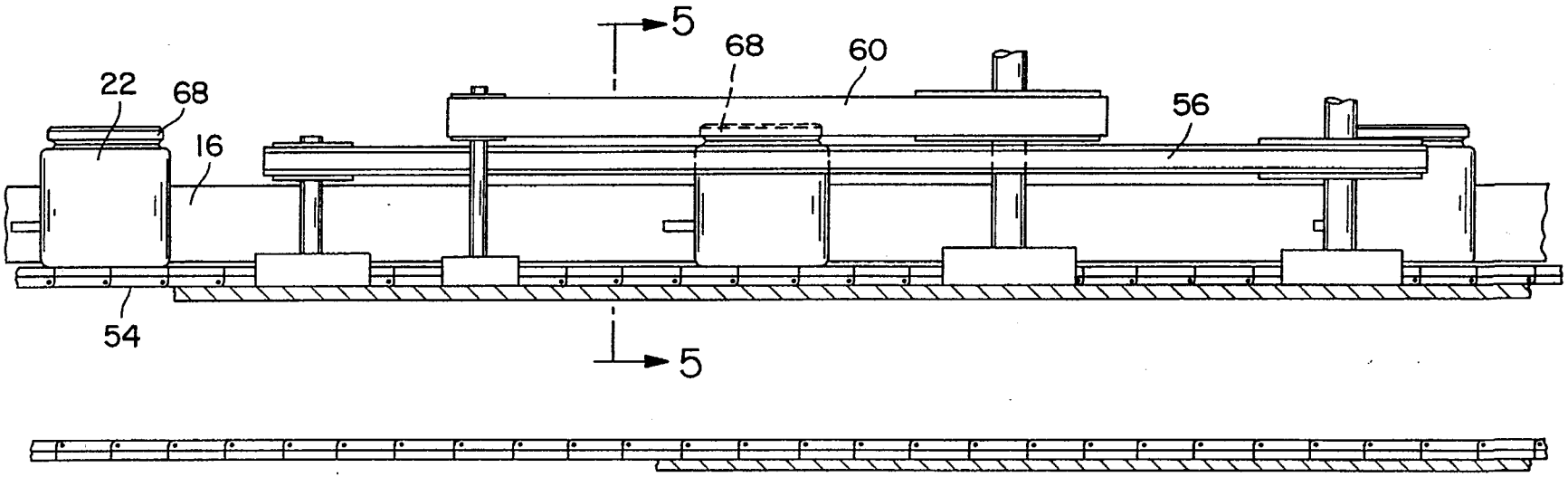
FIG. 4 is a sectional view, taken along the lines 4—4 in FIG.
Figure 5:
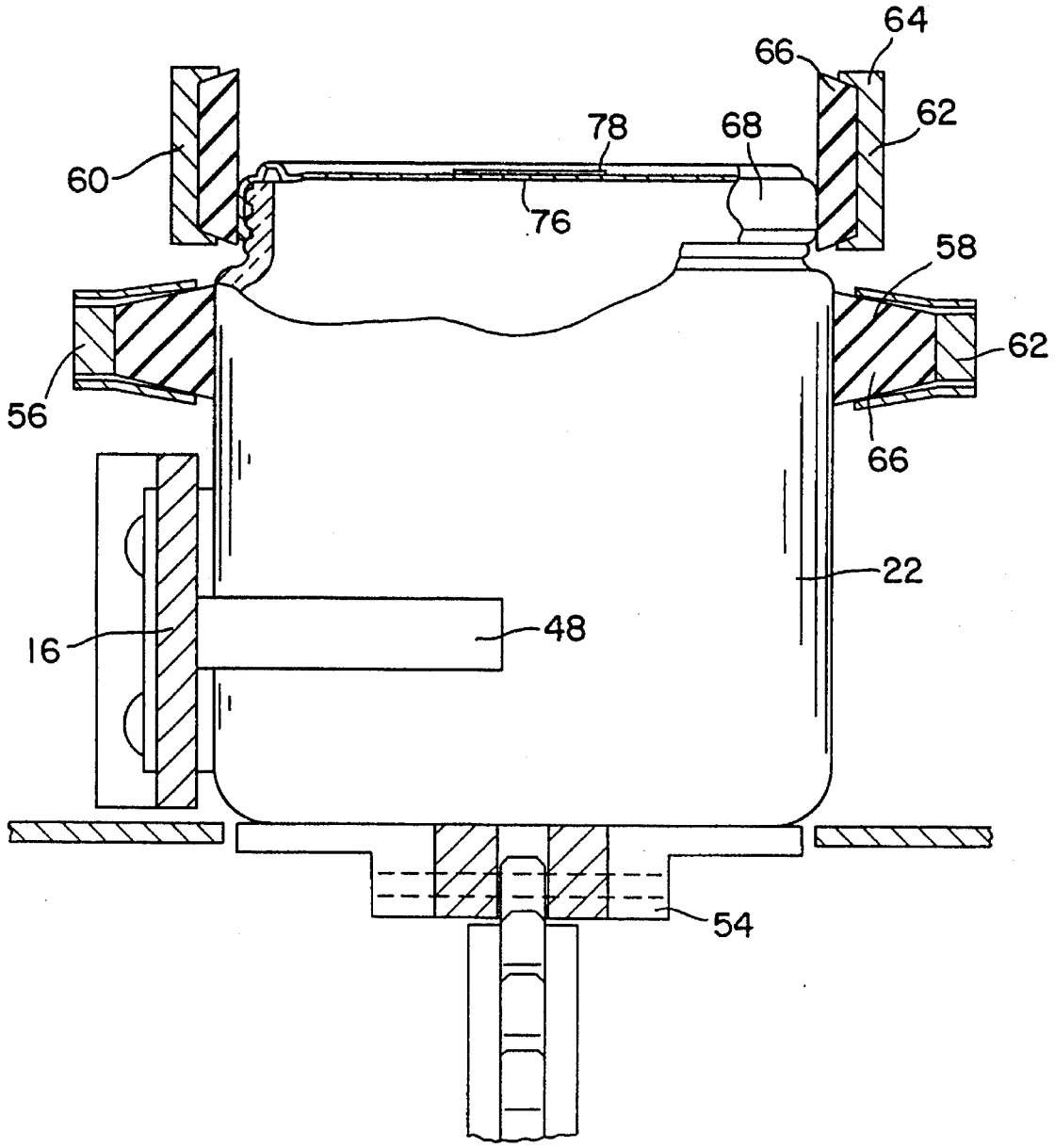
FIG. 5 is a sectional view, taken along the lines 5—5 in FIG.

Jar opening means 18 is shown in greater detail in FIGS. 3–5. Referring now to those figures, opening means 18 comprises a horizontal conveyor 54 in the form of an endless belt which moves in synchronism with conveyor 16. Individual jars 22 are conveyed from left to right, in the direction of the arrow in FIG. 3. As the jars are conveyed, they engage pairs of friction belts 56, 58 and 60, 62. Belts 56 and 58 form a pair of lower belts and belts 60 and 62 form a pair of upper belts relative to conveyor 54, as best seen in FIGS. 4 and 5. Each of belts 56, 58, 60 and 62 comprises a web 64 and a high-friction material 66 which engages individual jars as they are conveyed along. As best seen in FIGS. 4 and 5, lower belts 56 and 58 are positioned at a height above conveyor 54 so as to engage the sides of individual jars 22, while upper belts 60 and 62 are positioned at a height to engage the lids 68 of the jars.

Lower belts 56 and 58 are driven in synchronism with conveyors 16 and 54 by a drive motor 70. Drive motor 70 may be any conventional motor, such as a servo motor. The particular type of motor is not important to the invention, but what is important is that motor 70 drive belts 56 and 58 at the same linear speed as conveyors 16 and 54, so that the jars do not slip as they are conveyed.

Upper belt 62 is driven by a drive motor 72 at a linear speed which is less than the linear speed of belts 56 and 58. Upper belt 60 is driven by a drive motor 74 at a linear speed which is greater than the linear speed of belts 56 and 58. The speeds of drive motors 72 and 74 may be controlled to control the speeds of belts 60 and 62. As a result of the differential in linear speed between belts 60 and 62 and belts 56 and 58, belts 60 and 62 apply a twisting force to lid 68 in a counterclockwise direction so as to partially unscrew the lids and open the interior of the jars to the vacuum in vacuum chamber 12. This arrangement of differential-speed belts enables the amount of angular rotation of lids 68 to be controlled very precisely by controlling the relative speeds of the belts, and permits the jars to be partially opened so that their interiors are exposed to the vacuum, without having to stop the forward motion of the jars and without having to reduce the speed of the jars as they move along the conveyors.

After the jars are partially opened by passing through opening means 18, the warmed water inside the jars immediately begins to boil under the reduced pressure inside vacuum chamber 12. By the time the jars reach sealing station 20, where they are hermetically sealed, the pressure of the water vapor inside the jars has approached that of the vacuum chamber, but is slightly higher so that water vapor is continually produced up to the moment the jars are hermetically sealed. In any event, the pressure of the water vapor inside the jars is substantially below atmospheric pressure. Moreover, as the jars cool, some or all of the water vapor inside the jars will condense, leading to an even greater vacuum inside the jars. In fact, since the atmosphere inside the jars is almost pure water vapor, after the jars are cooled the pressure inside the jars will be close to that of the vaporization pressure of water at the jars' temperature, much lower than the pressure inside the vacuum chamber where the jars were sealed.

An important element of the present invention is that, because the containers are sealed under conditions of very high vacuum, there is very efficient temperature exchange between the product in the containers and the outside. Therefore, when the containers are subjected to thermal processes for sterilization after they have been sealed, temperature exchange between the sterilization chamber and the product in the containers will be excellent, and there will be an extremely rapid rise in temperature of the product. This is because the small amount of liquid which remains in the containers after sealing is almost immediately changed to vapor along the walls of the container. The vapor then condenses on the product, transferring the heat of vaporization to the product. This method of energy transfer permits very uniform temperature rise inside the container, which avoids the formation of "cold spots" on the product where complete sterilization might not occur. Conversely, when the containers are cooled, vapor in the container almost immediately condenses on the inside walls of the container, reducing the vapor pressure in the container and allowing liquid on the surfaces of the product to evaporate, thereby cooling the product.

Figure 6:
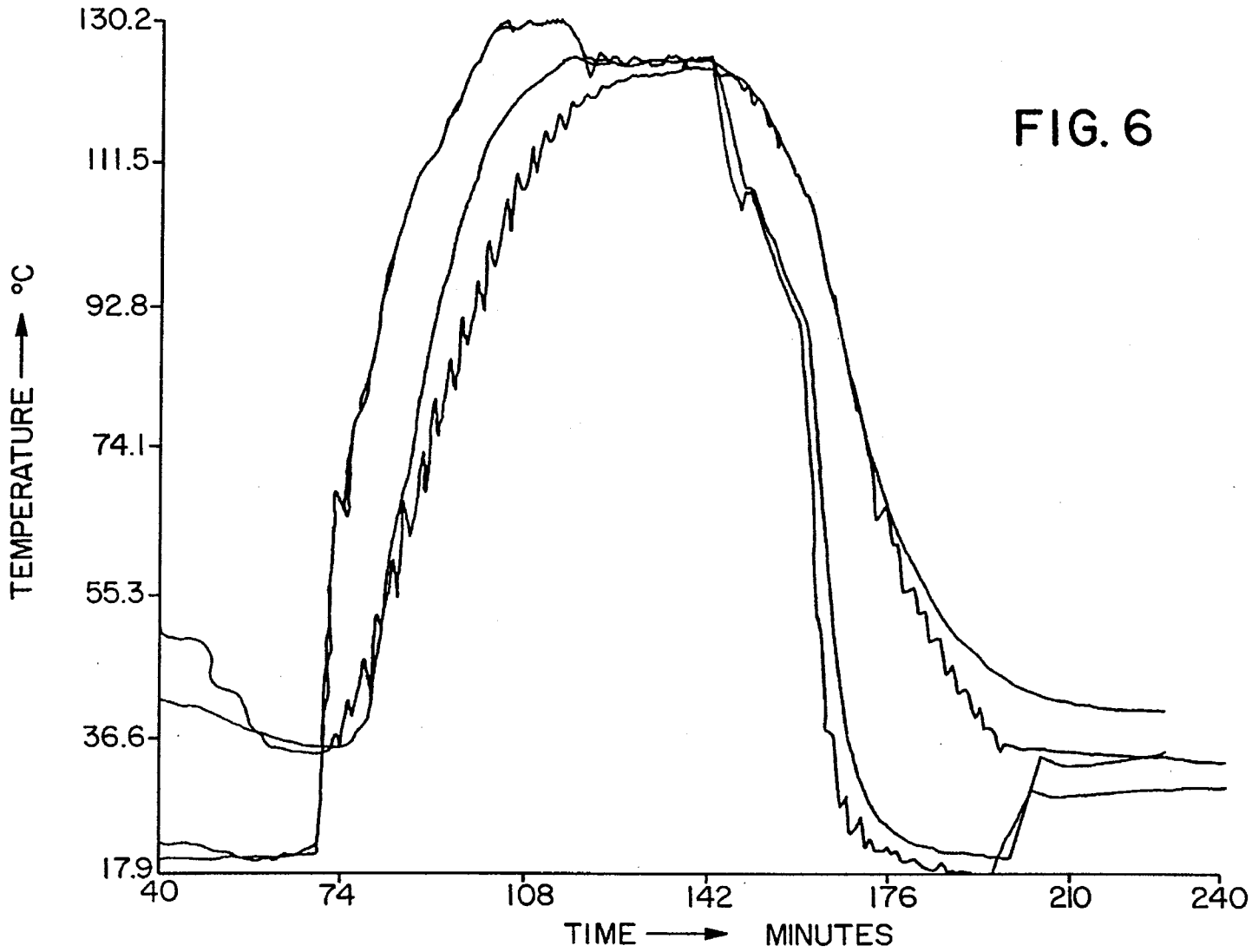
FIG. 6 is a graph illustrating temperature response of containers processed according to the invention as compared to conventionally processed containers.

This feature of the invention is illustrated graphically in FIG. 6, which is a graph of container temperature vs. time. In FIG. 6, the uppermost curve represents the temperature of the sterilizing chamber or autoclave. The center curve represents the temperature of a vacuum-sealed jar sealed in accordance with the present invention. The lower graph represents the temperature of a standard liquid-filled jar. It can be seen from FIG. 6 that the rise in temperature in the vacuum-sealed jar is uniform, while fluctuations are observed in the case of the liquid-filled jar. These fluctuations are attributed to the temperature differential existing between the liquid and the empty space at the jar's top. It is seen from FIG. 6 that the vacuum-sealed jar most rapidly reaches the sterilizing temperature, and that the rate of temperature rise is virtually identical to the rate of temperature rise of the autoclave. In contrast, the temperature within the liquid-filled jar rises at a considerably slower rate and only attains the sterilizing temperature (125° C.) after a considerable "plateauing-out" period. This means that the plateau must be extended considerably in order to obtain the desired sterilization. This is a disadvantage of conventional canning techniques, since any additional time spent at sterilization temperatures significantly increases cooking of the product and consequently leads to deterioration of their desirable organoleptic properties. The present invention, on the other hand, permits rapid sterilization of the product before the sterilization temperature has a chance to cook the product. This is a particular advantage with delicate products which are highly sensitive to temperature.

Because the jars are sealed under conditions of such high vacuum, the jars will be very difficult to open by the ultimate consumer. The present invention also contemplates a means for enabling the ultimate consumer to easily open a jar processed by the present invention. Referring to FIG. 5, it will be seen that the lid 68 is provided with an orifice 76 therethrough. Orifice 76 is small enough that it does not affect the lid's mechanical properties, such as its mechanical strength and rigidity. It is believed that a circular orifice having a diameter of about 5 mm is sufficient.

Prior to placing lid 68 on a jar 22, orifice 76 is sealed with a seal membrane 78. Membrane 78 is made of a material which is impervious to gases, particularly oxygen, and which does not give off any chemical substances which could adversely affect the contents of the jar. The membrane 78 must also be capable of withstanding processing temperatures up to 130° C. to which the lid might be exposed, and must also be capable of withstanding pressure differentials of up to 2 bars across the membrane. Finally, the membrane must be frangible, and easily ruptured by a sharp object or torn by hand when it is desired to break the seal and equalize the pressure inside the jar just prior to opening it. A suitable material for membrane 78 is a thin-skin aluminum-polyester self-stick membrane, known per se in the art.

The membrane seal 78 permits the jar to retain intact its original factory hermetic seal regardless of the presence of orifice 76 in lid 68, and permits the vacuum present in the jar after hermetic sealing to be relieved by the ultimate consumer just prior to opening the jar, so that opening is facilitated.

The present invention may be embodied in other specific forms without departing from the spirit or essential attributes thereof and, accordingly, reference should be made to the appended claims, rather than to the foregoing specification, as indicating the scope of the invention.

We claim:

1. A process for packaging foodstuffs in substantially rigid containers, comprising the steps of (a) placing a desired quantity of foodstuff to be packaged in said container, (b) adding to said container a quantity of aqueous liquid in an amount sufficient to generate, when boiled, vapor having a volume sufficiently in excess of the volume of said container to substantially completely displace all other gases from said container, (c) closing but not sealing said container so as to permit communication between the interior of said container and the ambient atmosphere, (d) warming said container and its contents to a temperature sufficient to generate said volume of vapor when said container is subjected to a pressure lower than atmospheric pressure, said temperature being as low as possible so that no cooking of the foodstuffs occurs, (e) exposing said warmed container to an ambient atmosphere having a pressure lower than atmospheric pressure, the ambient subatmospheric pressure being chosen so that the combination of the temperature of the liquid in said warmed container and the ambient subatmospheric pressure will result in the boiling of said liquid and the generation of said vapor in said container by vaporizing substantially all the liquid to drive out and substantially displace other gases from said container, and (f) hermetically sealing said container while exposed to said subatmospheric pressure.

2. The process of claim 1, wherein the combination of the temperature of the liquid and the subatmospheric pressure are chosen to satisfy the relation PV=nRT, where n is the amount, in mols, of vapor generated from said aqueous liquid.

3. The process of claim 1, wherein the quantity of aqueous liquid is an amount sufficient to generate, when boiled, vapor having a volume approximately fifty times the volume of the container.

4. The process of claim 1, wherein the temperature of the liquid is approximately 60° C.

5. The process of claim 1, wherein the subatmospheric pressure is approximately 0.2 bar absolute.

6. The process of claim 1, wherein the combination of the temperature of the liquid and the subatmospheric pressure are 60° C. and 0.2 bar absolute, respectively.

7. The process of claim 6, wherein the process comprises the further step of (g) covering at least portion of the container with an partially opaque covering for at least partially blocking light penetration into the container.

8. The process of claim 1, wherein the container comprises a glass container.

9. The process of claim 1, wherein in step (e) the warmed container is exposed to said ambient atmosphere for a period of time less than that which would cause the entire quantity of liquid to boil off, thereby leaving a residual amount of liquid in the container to enable rapid heat transfer between the outside of the container and the foodstuff therein upon subsequent thermal sterilization.

10. A process for expelling unwanted gases from a container and replacing said unwanted gases with a vapor phase of a desired liquid, comprising the steps of (a) adding to said container a quantity of desired liquid in an amount sufficient to generate, when boiled, a vapor phase having a volume sufficiently in excess of the volume of said container to substantially completely displace all other gases from said container, (b) warming said container and the desired liquid therein to a temperature sufficient to generate said volume of vapor when said container is subjected to a pressure lower than atmospheric pressure, (c) exposing said warmed container to an ambient atmosphere having a pressure lower than atmospheric pressure, the ambient subatmospheric pressure being chosen so that the combination of the temperature of the liquid in said warmed container and the ambient subatmospheric pressure will result in the boiling of said liquid and the generation of said vapor phase in said container by vaporizing substantially all the liquid to drive out and substantially displace other gases from said container.

11. A process for obtaining a desired vapor atmosphere in a sealed container, comprising the steps of (a) adding to said container a quantity of desired liquid in an amount sufficient to generate, when boiled, a vapor phase having a volume sufficiently in excess of the volume of said container to substantially completely displace all other gases from said container, (b) warming said container and the desired liquid therein to a temperature sufficient to generate said volume of vapor when said container is subjected to a pressure lower than atmospheric pressure, (c) exposing said warmed container to an ambient atmosphere having a pressure lower than atmospheric pressure, the ambient subatmospheric pressure being chosen so that the combination of the temperature of the liquid in said warmed container and the ambient subatmospheric pressure will result in the boiling of said liquid and the generation of said vapor phase in said container by vaporizing substantially all the liquid to drive out and substantially displace other gases from said container, and (d) hermetically sealing said container while exposed to said subatmospheric pressure.

12. A process for expelling unwanted gases from a container and replacing said unwanted gases with a vapor phase of a desired liquid, comprising the steps of:

adding to said container a quantity of desired liquid in an amount substantially less than the volume of the container yet sufficient to generate, when boiled, a vapor phase having a volume sufficiently in excess of the volume of said container to substantially completely displace all other gases from said container;

warming said container and the desired liquid therein to a temperature sufficient to generate said volume of vapor when said container is subjected to a pressure lower than atmospheric pressure; and exposing said warmed container to an ambient atmosphere having a pressure lower than atmospheric pressure, the ambient subatmospheric pressure being chosen so that the combination of the temperature of the liquid in said warmed container and the ambient subatmospheric pressure will result in the boiling of said liquid and the generation of said vapor phase in said container by vaporizing substantially all the liquid to drive out and substantially displace other gases from said container.

13. A process according to claim 12 wherein the quantity of liquid added is approximately five percent of the total container volume.

14. A process for packaging foodstuffs comprising the steps of:

placing a desired quantity of foodstuff to be packaged in a container;

adding to the container a quantity of liquid;

warming the container and its contents to a temperature sufficient to vaporize said liquid upon exposure to a pressure lower than atmospheric pressure;

vaporizing substantially all of said liquid by exposing said warmed container to an atmosphere having a pressure lower than atmospheric pressure, the subatmospheric pressure being chosen so that the combination of the temperature of the liquid in said warmed container and the subatmospheric pressure result in the vaporizing of said liquid in said container to drive out and substantially displace other gases from said container.

* * * * *